United States Patent [19]

Murakami et al.

[11] 4,159,472

[45] Jun. 26, 1979

[54] ELECTRONIC BUZZER

[75] Inventors: Fumikazu Murakami; Shigeo Mori; Yoshiaki Hara; Ichiro Horikoshi; Soya Takahashi, all of Tokyo, Japan

[73] Assignee: Kabushiki Kaisha Daini Seikosha, Japan

[21] Appl. No.: 815,441

[22] Filed: Jul. 13, 1977

[30] Foreign Application Priority Data

Jul. 13, 1976 [JP] Japan ..... 51-83317

[51] Int. Cl.[2] ..... G08B 3/00

[52] U.S. Cl. ..... 340/384 R; 340/388

[58] Field of Search ..... 340/384 R, 388; 181/163

[56] References Cited

U.S. PATENT DOCUMENTS

| | | | |
|---|---|---|---|
| 1,773,605 | 8/1930 | Sefton | 181/163 |
| 2,071,828 | 2/1937 | Glen | 181/163 |
| 2,903,673 | 9/1959 | Harris | 181/163 |
| 3,074,504 | 1/1963 | Trautman | 181/163 |

*Primary Examiner*—Harold I. Pitts

*Attorney, Agent, or Firm*—Robert E. Burns; Emmanuel J. Lobato; Bruce L. Adams

[57] ABSTRACT

A miniature electronic buzzer for an electronic watch has two vibrating plates with a sealed space between them forming an air spring. One of the vibrating plates carries an amarature which is acted upon by an electromagnetic to vibrate said plate. Vibration is imparted to the other vibrating plate by the air spring. The two vibrating plates and coupling air spring constitute a vibrating system having two resonant frequencies in the audible range. The electromagnet is energized by current having a frequency in the neighborhood of these resonant frequencies. There may be a third vibrating plate coupled with the second vibrating plate by a second air spring. In this event the vibrating system has three resonant frequencies in the audible range.

9 Claims, 12 Drawing Figures

ELECTRONIC BUZZER

FIELD OF THE INVENTION

The present invention relates to an electronic buzzer and particularly to a minature buzzer suitable for use in an electronic watch.

BACKGROUND OF THE INVENTION

A vibrating plate driven by a frequency in the neighborhood of the resonance frequency of the vibrating plate is very effective for an electronic buzzer. This is especially true if the electronic buzzer is of minature size and should be operated with low power as in an electronic watch.

However, in the conventional electronic buzzer having a single vibrating plate, the frequency band which obtains sufficient sound pressure is very narrow whereby it is necessary to provide an adjusting means for adjusting the driving frequency. Moreover, it is very inconvenient to change the sound tone of the buzzer so as to generate sounds of different types.

SUMMARY OF THE INVENTION

It is an object of the present invention to provide an electronic buzzer overcoming the disadvantages of the prior art. In accordance with the invention the vibrating member is composed of a plurality of vibrating plates which are spaced apart and coupled by an air spring with each other. In accordance with the invention it is possible to provide a variable sound band by setting resonance frequencies of the vibrating plates to audible frequency. Furthermore, variable sounds can be obtained by selecting driving frequencies.

BRIEF DESCRIPTION OF DRAWINGS

The nature, objects, and advantages of the invention will be more fully understood from the following description in conjunction with the accompanying drawings in which.

DESCRIPTION OF PRIOR ART

Figure 1:
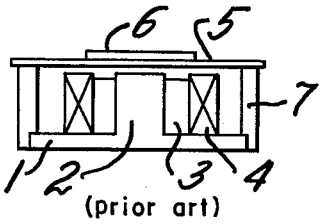
FIG. 1 is a side sectional view of an electronic buzzer of conventional type.

In FIG. 1 there is shown by way of example a conventional electronic buzzer comprising a plate 1 composed of an annealed magnetic material, a center pole 2 which is composed of annealed magnetic material, a coil 3 which is wound around the center pole 2 and a magnetic ring member 4 which surrounds the coil 3. A vibrating plate 5 on which an annealed magnetic member 6 is mounted is supported by a supporting member 7 in position for actuation of the vibrating plate by an alternating or intermittent current supplied to the coil 3.

In an electric current $\mathring{I}=I \sin Wt$ is applied to the coil 3, a driving power $\mathring{F}$ which activates the driving plate 5 as K of a coefficient of a transducer is as follows:

$$\mathring{F}=KI \sin Wt \tag{1}$$

Figure 9:
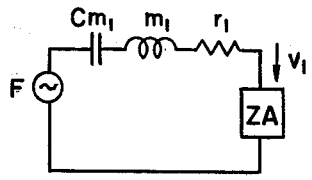
FIG. 9 shows an equivalent mechanical circuit of a conventional electronic buzzer as shown in FIG. 1.

The driving plate 5 is vibrated by the driving power $\mathring{F}$. In this case the driving power $\mathring{F}$ is considered as a voltage and the vibrating speed $\mathring{V}_1$ is considered as a current. An equivalent mechanical circuit of the vibrating system is illustrated in FIG. 9 where $Cm_1$, $m_1$ and $r_1$ are the compliance, actual mass and mechanical resistance of the vibrating plate 5 including the plate 6 of annealed magnetic material. XA is the acoustic load impedance. If the driving power $\mathring{F}$ is constant without relation to a frequency, an electric current which flows in ZA (vibrating speed $\mathring{V}1$) becomes largest at $f_1$ as follows:

$$f_1=\tfrac{1}{2}\pi\sqrt{Cm_1 \cdot m_1} \tag{2}$$

Figure 4:
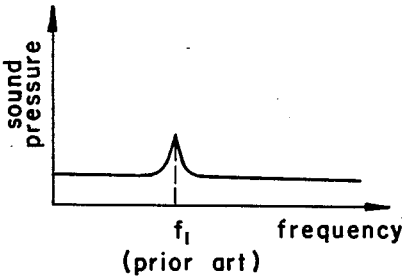
FIG. 4 is a curve showing a characteristic of a conventional electronic buzzer as shown in FIG. 1, FIGS. 5 and 6 are curves showing the characteristics of an electronic buzzer in accordance with the present invention as shown in FIG. 2, FIGS. 7 and 8 are curves showing the characteristics of an electronic buzzer in accordance with the present invention as shown in FIG. 3.

Thus, in this case, the relation between the frequency and the acoustic pressure is maximum in the neighborhood of $f_1$ as shown in FIG. 4. Hence, in order to have the buzzer operate efficiently, it is necessary to adjust or control the frequency so that its value is close to $f_1$. The buzzer is capable of producing sound of only one frequency.

DESCRIPTION OF PREFERRED EMBODIMENTS

Figure 2:
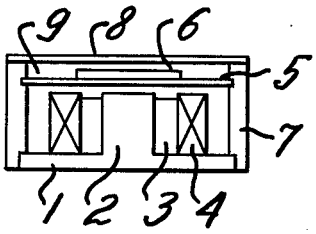
FIG. 2 is a side sectional view of an electronic buzzer in accordance with the invention having two vibrating plates.

An electronic buzzer in accordance with the present invention as shown by way of example in FIG. 2 comprises a base plate 1 of annealed magnetic material, a center pole 2 of annealed magnetic material projecting from the base plate 1 and a coil or winding 3 which is wound around the center pole 2. The coil 3 is surrounded by a magnetic ring member 4 which likewise projects upwardly from the base plate 1. A first vibrating plate 5 is disposed above the center pole 2 and magnetic ring member 4 with a certain air gap and is supported at its periphery by an annular supporting member 7 wich projects upwardly from the base plate 1. An armature 6 comprising a plate composed of annealed magnetic material is mounted on the first vibrating plate 5 so as to provide a magnetic loop comprising the armature 6, magnetic ring member 4, base plate 1 and center pole 2.

In accordance with the invention, a second vibrating plate 8 is mounted on the supporting member 7 with an air space 9 between the first vibrating plate 5 and the second vibrating plate 8.

If an electronic current supplied to the coil 3 is $\mathring{I}=I \sin Wt$ and the power coefficient is "K" there is produced a driving power $\mathring{F}$ which is equal to equation (1) and which actuates the first vibrating plate 5. The air in the space 9 between the two plates 5 and 6 acts as an air spring causing the plate 6 also to vibrate. Thus a vibrating system which is composed of the first vibrating plate 5, air spring 9 and second vibrating plate 8 is vibrated by the driving force F.

Figure 10:
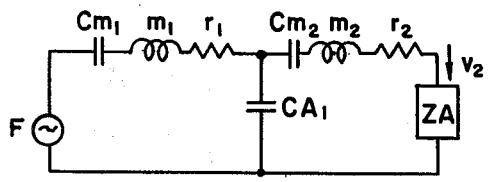
FIG. 10 shows an equivalent mechanical circuit of an electronic buzzer in accordance with the present invention as shown in FIG. 2.

An equivalent mechanical circuit is shown in FIG. 10 where $Cm_1$, $m_1$ and $r_1$ are respectively compliance, effective mass and mechanical resistance in the first vibrating plate 5. $Cm_2$, $m_2$ and $r_2$ are respectively compliance, effective mass and mechanical resistance in the second vibrating plate 8. $CA_1$ is compliance of the air space 9 and is shown as follows:

$$CA_1 = W_1/(C^2 \cdot \rho \cdot S^2) \quad (3)$$

Where:

The effective dimensions of first and second vibrating plates are equal,

Effective dimension: S

Volume of air space: $W_1$

Sound speed: C

Density of air: $\rho$

Further, ZA is an acoustic load impedance from the second vibrating plate 8. A peripheral portion of the vibrating plate 8 is supported by the supporting member 7 so that vibration of the vibrating plate is zero at the supported peripheral portion and is maximum in a central portion. An equivalent mass in changing it to a piston operation is an effective mass and an equivalent dimension.

Figure 5:
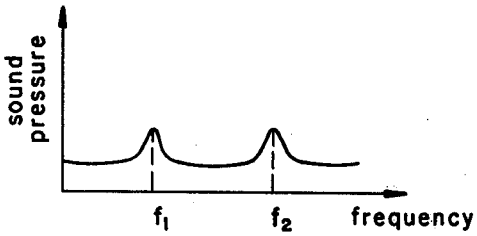

If the driving power $\mathring{F}$ is constant without relation to the frequency in FIG. 10 there are two points of frequency in which the electric current in ZA becomes a peak these two points being shown as $f_1$ and $f_2$ in FIG. 5.

The two peaks of acoustic pressure can be presumed according to the equivalent mechanical circuit of FIG. 10. Namely, if the mechanical resistance $r_2$ and ZA are smaller than other impedance, the vibrating speed $\mathring{V}$ of the second vibrating plate is as follows:

$$\mathring{V}_2 = \{F \cdot m_1 \cdot Cm_2 \cdot \omega \cdot /(A\omega^4 - B\omega^2 + C) \cos \omega t\} \quad (4)$$

Where $\omega$ is angular frequency and A, B and C are constant as follows:

$$A = m_1 \cdot m_2 \cdot Cm_2 \cdot CA_1$$

$$B = (m_1 Cm_1 Cm_2 + m_1 \cdot Cm_1 \cdot CA_1 + m_2 Cm_2 CA_1 + Cm_1 m_2 Cm_2)$$

$$C = Cm_1 + Cm_2 + CA_1$$

According to formula (4), in $A\omega^4 - B\omega^2 + C = 0$, $\mathring{V}_2$ becomes about peak whereby $f_1$ and $f_2$ are as follows:

$$f_1 = \{\tfrac{1}{2}-\} \frac{\sqrt{B - \sqrt{B^2 - 4AC}}}{2A} \quad (5)$$

$$f_2 = \{\tfrac{1}{2}-\} \frac{\sqrt{B + \sqrt{B^2 - 4AC}}}{2A} \quad (6)$$

Figure 6:
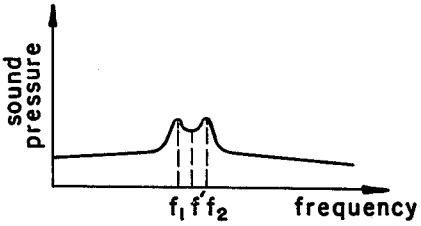

The peak frequencies are in the neighborhood of $f_1$ and $f_2$ whereby the characteristic illustrated in FIG. 5 is obtained. The curve of FIG. 5 shows a condition in which $f_1$ and $f_2$ are spaced. However, it is possible to get $f_1$ and $f_2$ nearer one another as shown in FIG. 6. According to equations (5) and (6), it is possible to get $f_1$ and $f_2$ near one another by minimizing the value of $\sqrt{B^2 - 4AC}$ to the value of B.

Figure 3:
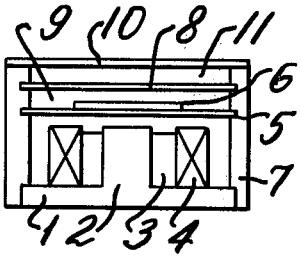
FIG. 3 is a side sectional view of an electronic buzzer in accordance with the present invention having three vibrating plates.
Figure 11:
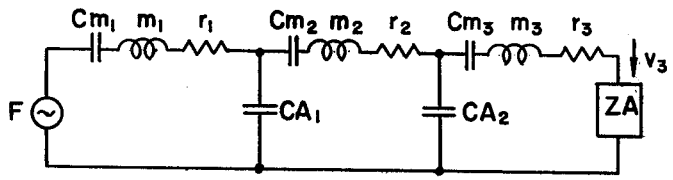
FIG. 11 shows an equivalent mechanical circuit of an electronic buzzer in accordance with the present invention as shown in FIG. 3.

A further embodiment of an electronic buzzer in accordance with the invention is illustrated in FIG. 3 which shows a construction in which a third vibrating plate 10 is mounted on the supporting member 7 with an air space 11 between the third vibrating plate 10 and the second vibrating plate 8. The first vibrating plate 5 with annealed magnetic member 6 and second vibrating plate 8 are of the same construction as in FIG. 2. In this case an equivalent mechanical circuit of a vibrating system which is composed of the first vibrating plate 5, the air space 9, the second vibrating plate 8, the air space 11 and the third vibrating plate 10 is illustrated in FIG. 11.

A driving power $\mathring{F}$ is obtained by equation (1). $Cm_3$, $m_3$ and $r_3$ are the compliance, equivalent mass and mechanical resistance of the third vibrating plate 10. Further $CA_2$ is the compliance of the air space 11 and is shown as follows:

$$CA_2 = \omega_2/(C^2 \cdot \rho \cdot S^2) \quad (7)$$

Where:

The effective dimensions of second and third vibrating plates are equal,

Effective dimension: S

Volume of air room: $W_1$

The other circuit constants are the same as for FIG. 10.

According to FIG. 11, there are three frequencies in which the electric current in ZA becomes peaks namely $f_1$, $f_2$ and $f_3$. The sound pressure becomes peak in the neighborhood of the frequencies of $f_1$, $f_2$ and $f_3$. The frequency characteristic of sound pressure of the electronic buzzer of FIG. 3 is shown in FIG. 7.

Figure 7:
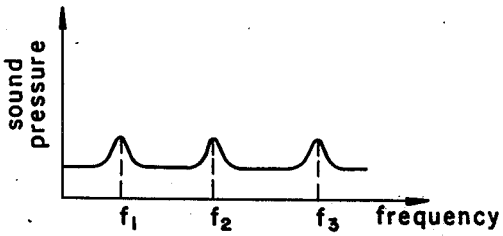
Figure 8:
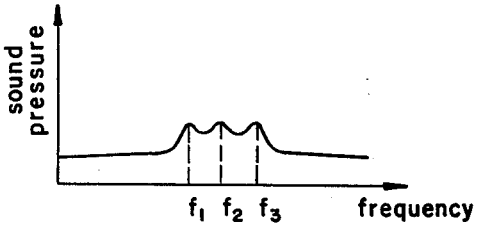

FIG. 7 shows a condition in which $f_1$, $f_2$ and $f_3$ are spaced from each other. However, it is possible to get $f_1$, $f_2$ and $f_3$ nearer one another as illustrated in FIG. 8 by selecting a constant of the vibrator system. Therefore, it is possible to obtain a resonance point in accordance with the number of vibrating plates and air spaces.

In the embodiments of the present invention illustrated in FIGS. 2 and 3, transmission of driving power between the several vibrating plates is through the air chamber 9 in FIG. 2 and air chambers 9 and 11 in FIG. 3.

Figure 12:
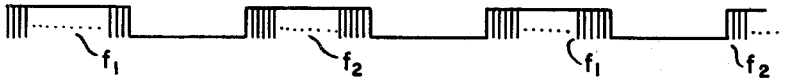
FIG. 12 shows a waveform of a driving current for driving an electronic buzzer having the characteristic of FIG. 5 with frequencies $f_1$ and $f_2$.

According to the present invention with an electronic buzzer having the characteristics shown in FIGS. 5 and 6, it is possible to obtain a strong sound pressure by using a driving current $\mathring{I}$ which is intermittently changed to $f_1$ and $f_2$ as indicated in FIG. 12. Further it is possible simultaneously to use two resonant points by applying a driving current including the components of $f_1$ and $f_2$ which has the frequency component of a fourier transformer of a driving current waveform whereby it is possible to change the sound tone by using two frequencies. Thus it is very convenient to make a code of sound and a unique sound.

Further it is possible to obtain the above noted effects in a buzzer which has three frequency points of $f_1$, $f_2$ and $f_3$. As another effect it is possible to obtain a spread width by setting a frequency of a driving current as f' between $f_1$ and $f_2$, as illustrated in FIG. 6, and as $f_2$ between $f_1$ and $f_3$ in FIG. 8 by using an electronic buzzer in which the resonance points approach each other as indicated in FIGS. 6 and 8.

In accordance with the present invention it is possible to permit greater tolerances in manufacture since the frequency of the driving current is no longer critical. The air coupling construction of the vibrating plates as indicated in FIGS. 2 and 3 is very effective and is preferred to a construction employing a mechanical spring member.

In conventional electronic buzzers a thin synthetic resin membrane is sometimes used as a dust and moisture proof cover over the vibrating plate. However, the resonant frequency of such membrane is nonaudible whereby it is not possible to obtain a resonance sound effect. Such membrane, hence, in no way corresponds to the second or third vibrating plates of the present invention by which a resonance sound effect can be obtained.

What is claimed is:

1. A miniature electronic buzzer comprising in combination a driving means, a vibrating assembly composed of a first vibrating plate and a secondary vibrating plate and a sealed air space between said two vibrating plates, wherein said driving means drives said first vibrating plate by a mechanical power generated from an electronic input signal, and vibration of said first vibrating plate is transmitted to said secondary vibrating plate through said sealed air space, and vibration of said secondary vibrating plate generates a sound wave to the air, both of two resonant frequencies generated from said secondary vibrating plate being audible, and said driving means having a frequency in the neighborhood of said two resonant frequencies.

2. An miniature electronic buzzer according to claim 1, wherein said vibrating assembly comprises a third vibrating plate and a secondary sealed air space between said secondary vibrating plate and said third vibrating plate, said third vibrating plate being driven by vibration of a secondary vibrating plate through said secondary air space, and vibration of said third vibrating plate generating a sound wave to the open air, said driving means having a frequency in the neighborhood of three resonant audible frequencies generated by said third vibrating plate.

3. A miniature electronic buzzer for an electronic watch comprising a base plate of magnetic material, a center pole of magnetic material projecting up from the base plate, a winding around said center pole, a magnetic ring member projecting up from said base plate and surrounding said coil, a first vibrating plate disposed above said center pole and magnetic ring member with an air gap between them, means supporting said first vibrating plate by its periphery, a second vibrating plate disposed above and spaced from said first vibrating plate, means supporting said second vibrating plate by its periphery and sealing the space between said vibrating plates to form an air spring coupling said vibrating plates with one another to constitute a vibrating system having two resonant frequencies in the audible range, an armature of magnetic material on the first only of said vibrating plate so as to provide a magnetic loop comprising said armature, said magnetic ring member, said base plate and said center pole, and energizing means for supplying driving current to said coil with a frequency in the neighborhood of said two resonant frequencies to produce vibration of said first vibrating plate magnetically, the vibration of said first vibrating plate being transmitted to said second vibrating plate by said air spring.

4. A miniature electronic buzzer according to claim 3, in which said energizing means supplies driving current to said coil with a frequency between said two resonant frequencies.

5. A miniature electronic buzzer according to claim 3, in which said energizing means applies to said coil a driving current having components with frequencies corresponding respectively to said two resonant frequencies.

6. A miniature electronic buzzer according to claim 3, in which said energizing means supplies to said coil a driving current which is intermittently changed between said two resonant frequencies.

7. A miniature electronic buzzer according to claim 3, in which said first and second vibrating plates are of the said diameter.

8. A miniature electronic buzzer according to claim 3, further comprising a third vibrating plate disposed above and spaced from said second vibrating plate and means supporting said third vibrating plate by its periphery and sealing the space between said second and third vibrating plates to form a second air spring coupling said second and third vibrating plates with one another to provide with said first vibrating plate and said first mentioned air spring a vibrating system having three resonant frequencies in the audible range, said energizing means supplying to said coil driving current having a frequency in the neighborhood of said three resonant frequencies.

9. A miniature electronic buzzer according to claim 8, in which said first, second and third vibrating plates are of the same diameter.

* * * * *